US008715369B2

(12) United States Patent
Batchelor et al.

(10) Patent No.: US 8,715,369 B2
(45) Date of Patent: May 6, 2014

(54) LAUNDRY TREATMENT COMPOSITIONS

(75) Inventors: Stephen Norman Batchelor, Wirral (GB); Jayne Michelle Bird, Wirral (GB)

(73) Assignee: The Sun Products Corporation, Wilton, CT (US)

( * ) Notice: Subject to any disclaimer, the term of this patent is extended or adjusted under 35 U.S.C. 154(b) by 0 days.

(21) Appl. No.: 13/618,577

(22) Filed: Sep. 14, 2012

(65) Prior Publication Data

US 2013/0174358 A1 Jul. 11, 2013

Related U.S. Application Data

(63) Continuation of application No. 11/663,578, filed as application No. PCT/EP2005/009846 on Sep. 9, 2005, now Pat. No. 8,268,016.

(30) Foreign Application Priority Data

Sep. 23, 2004 (GB) ..... 0421147.0
Apr. 27, 2005 (GB) ..... 0508484.3

(51) Int. Cl.
*C11D 3/40* (2006.01)
*D06L 3/12* (2006.01)

(52) U.S. Cl.
USPC ..... 8/525; 8/648; 8/657; 8/661; 8/663; 510/276

(58) Field of Classification Search
USPC ..... 8/648
See application file for complete search history.

(56) References Cited

U.S. PATENT DOCUMENTS 3,172,723 A 3/1965 Hay et al.
3,186,155 A 6/1965 Breen et al.
3,215,486 A 11/1965 Hada et al.
3,415,904 A 12/1968 Taniguchi et al.
3,575,866 A 4/1971 Strobel et al.
3,584,991 A 6/1971 Sturkey
3,748,093 A 7/1973 Gangwisch et al.
3,755,201 A 8/1973 Trimmer et al.
3,758,335 A 9/1973 Bergman et al.
3,841,831 A 10/1974 Miller
3,941,791 A 3/1976 Hell et al.
3,958,928 A * 5/1976 Lala ..... 8/643
4,077,765 A 3/1978 Rosati
4,091,034 A 5/1978 Kuhn
4,110,238 A 8/1978 Lala
4,167,628 A 9/1979 Kormany
4,196,103 A 4/1980 Richter
4,197,087 A 4/1980 Ami et al.
4,270,236 A 6/1981 Zurbuchen et al.
4,283,197 A 8/1981 Schürings et al.
4,454,146 A 6/1984 Borovian
4,460,374 A 7/1984 Abel et al.
4,494,957 A * 1/1985 Niwa et al. ..... 8/639
4,601,725 A 7/1986 Keller et al.
4,602,916 A 7/1986 Wilson
4,728,453 A 3/1988 Choy
4,800,037 A 1/1989 Mazzola
4,886,517 A 12/1989 Bugaut et al.
4,908,040 A 3/1990 Naef et al.
5,049,311 A 9/1991 Rasheed et al.
5,998,351 A 12/1999 Brouwer et al.
6,214,963 B1 4/2001 Noguchi et al.
6,521,581 B1 2/2003 Hsu et al.
6,712,890 B2 3/2004 Hadjisoteriou et al.
7,235,518 B2 6/2007 Brush et al.
2002/0062763 A1 5/2002 Macholdt et al.
2002/0151235 A1 10/2002 Bartl et al.
2005/0227890 A1 10/2005 Van Dijk et al.
2005/0288206 A1* 12/2005 Sadlowski et al. ..... 510/392
2009/0217467 A1 9/2009 Batchelor et al.
2010/0093591 A1 4/2010 Lant
2010/0115707 A1 5/2010 Batchelor et al.

OTHER PUBLICATIONS

Hohener, Application No. EP 03102447.4, filing date Jun. 8, 2003 and attached as a PDF.*

* cited by examiner

*Primary Examiner* — Harold Pyon
*Assistant Examiner* — Katie L Hammer
(74) *Attorney, Agent, or Firm* — Sterne, Kessler, Goldstein & Fox P.L.L.C.

(57) ABSTRACT

The present invention provides a treatment composition comprising a hydrophobic dye.

13 Claims, No Drawings

LAUNDRY TREATMENT COMPOSITIONS

This is a continuation of application Ser. No. 11/663,578, §371 date: Mar. 23, 2007, now U.S. Pat. No. 8,268,016 which is the U.S. National Phase of International Application No. PCT/EP2005/09846, filed Sep. 9, 2005, which claims priority to GB 0508484.3, filed Apr. 27, 2005, and GB 0421147.0, filed Sep. 23, 2004, the entire contents of each are hereby incorporated by reference in their entirety.

TECHNICAL FIELD

The present invention relates to laundry treatment compositions that comprise a dye.

BACKGROUND OF THE INVENTION

Garments comprising polyester fibres are ubiquitous. Many garments are white but over the lifetime of these garments the whiteness is dulled reducing the aesthetic value of the garment. There is a need to maintain the white appearance of such garments such that the aesthetic value is retained as long as possible.

Bleach, fluorescers and shading agents are used in modern wash processes to maintain whiteness. The fluorescers and shading agents that are currently available, do not deposit on polyester fibres of garments to a significant degree. All fibres may be subjected to a bleaching process but over time such treatment can lead to the garment taking a yellow hue.

There is a need to provide technology that maintains and enhances the white appearance of polyester comprising garments.

SUMMARY OF THE INVENTION

Dyes disclosed herein are known to be used to dye textiles in industrial processes conducted at high temperatures together with high concentrations of dyes and dispersion agents. Surprisingly the dyes can be used to shade at low levels of dye and surfactant and at routine laundry temperatures. We have found that hydrophobic dyes are substantive to polyester, fibres under normal domestic wash conditions. At low levels of dye a shading whiteness benefit is provided.

In one aspect the present invention provides a laundry treatment composition comprising between 0.0001 to 0.1 wt % of a hydrophobic dye selected from benzodifuranes, methine, triphenylmethanes, napthalimides, pyrazole, napthoquinone and mono-azo or di-azo dyes, and between 2 to 60 wt % of a surfactant. It is preferred that the dye is a mono-azo dye.

In another aspect the present invention provides a method of treating a textile, the method comprising the steps of: (i) treating a textile with an aqueous solution of the hydrophobic dye, the aqueous solution comprising from 1 ppb to 6 ppm of the hydrophobic dye and from 0.2 g/L to 3 g/L of a surfactant; and, (ii) rinsing and drying the textile. It is preferred that the aqueous solution has an ionic strength from 0.001 to 0.5. It is preferred that the hydrophobic dye is present in the range 10 ppb to 200 ppb. In another aspect it is preferred that the aqueous solution also comprises from 1 ppb to 5 ppm one or more other dyes selected from cotton substantive shading dyes of group consisting of: hydrolysed reactive dye; acid dye; and direct dye.

A "unit dose" as used herein is a particular amount of the laundry treatment composition used for a type of wash, conditioning or requisite treatment step. The unit dose may be in the form of a defined volume of powder, granules or tablet or unit dose detergent liquid.

DETAILED DESCRIPTION OF THE INVENTION

Typical dye suppliers may be found in the colour index, and include Clariant, Dystar, Ciba & BASF.

Hydrophobic dyes are defined as organic compounds with a maximum extinction coefficient greater than 1000 L/mol/cm in the wavelength range of 400 to 750 nm and that are uncharged in aqueous solution at a pH in the range from 7 to 11. The hydrophobic dyes are devoid of polar solubilizing groups. In particular the hydrophobic dye does not contain any sulphonic acid, carboxylic acid, or quaternary ammonium groups. The dye chromophore is preferably selected from the group comprising: azo; methine, pyrazole napthoquinone, phthalocyanine; and, triphenylmethane chromophores. Most preferred are azo dye chromophores.

Many examples of hydrophobic dyes are found in the classes of solvent and disperse dyes.

Shading of white garments may be done with any colour depending on consumer preference. Blue and Violet are particularly preferred shades and consequently preferred dyes, or mixtures of dyes are ones that give a blue or violet shade on white polyester.

It is preferred that the dye(s) have a peak absorption wavelength of from 550 nm to 650 nm, preferably from 570 nm to 630 nm. A combination of dyes may be used which together have the visual effect on the human eye as a single dye having a peak absorption wavelength on polyester of from 550 nm to 650 nm, preferably from 570 nm to 630 nm. This may be provide for example by mixing a red and green-blue dye to yield a blue or violet shade.

A wide range of suitable solvent and disperse dyes are available. However detailed toxicological studies have shown that a number of, such dyes are possible carcinogens, such dyes are not preferred.

Preferred mono-azo dyes are of the form:

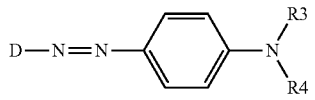

wherein R3 and R4 are optionally substituted C2 to C12 alkyl chains having optionally therein ether (—O—) or ester links, the chain being optionally substituted with —Cl, —Br, —CN, —$NO_2$, and —$SO_2CH_3$; and, D denotes an aromatic or heteroaromatic group. Preferably D is selected from the group consisting of: thiophenes, benzothiazoles, and pyridones.

It is preferred that R3 is —CH2CH2R5 and R4 and is —CH2CH2R6 and R5 and R6 are independently selected from the group consisting of: H, —CN, —OH, —C6H5, —OCOR7 and —COOR7, and that R7 is independently selected from: aryl and alkyl. Preferred aryl are —C6H5 and C10H7.

The following is an example of a preferred class of mono-azo dyes:

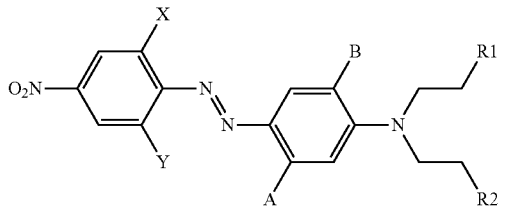

where X and Y are independently selected from the group consisting of: —H, —Cl, —Br, —CN, —$NO_2$, and —$SO_2CH_3$;

A is selected —H, —$CH_3$, —Cl, and —NHCOR;

B is selected —H, —$OCH_3$, —$OC_2H_5$, and —Cl;

$R^1$ and $R^2$ are independently selected from the group consisting of: —H, —CN, —OH, —OCOR, —COOR, -aryl; and R is C1-C8-alkyl.

The following are preferred azo dyes: Disperse blue 10, 11, 12, 21, 30, 33, 36, 38, 42, 43, 44, 47, 79, 79:1, 79:2, 79:3, 82, 85, 88, 90, 94, 96, 100, 101, 102, 106, 106:1, 121, 122, 124, 125, 128, 130, 133, 137, 138, 139, 142, 146, 148, 149, 165, 165:1, 165:2, 165:3, 171, 173, 174, 175, 177, 183, 187, 189, 193, 194, 200, 201, 202, 206, 207, 209, 210, 211, 212, 219, 220, 224, 225, 248, 252, 253, 254, 255, 256, 257, 258, 259, 260, 264, 265, 266, 267, 268, 269, 270, 278, 279, 281, 283, 284, 285, 286, 287, 290, 291, 294, 295, 301, 304, 313, 315, 316, 317, 319, 321, 322, 324, 328, 330, 333, 335, 336, 337, 338, 339, 340, 341, 342, 343, 344, 345, 346, 351, 352, 353, 355, 356, 358, 360, 366, 367, 368, 369, 371, 373, 374, 375, 376 and 378, Disperse Violet 2, 3, 5, 6, 7, 9, 10, 12, 13, 16, 24, 25, 33, 39, 42, 43, 45, 48, 49, 50, 53, 54, 55, 58, 60, 63, 66, 69, 75, 76, 77, 82, 86, 88, 91, 92, 93, 93:1, 94, 95, 96, 97, 98, 99, 100, 102, 104, 106 or 107, Dianix violet cc and dyes with CAS-No's 42783-06-2, 210758-04-6, 104366-25-8, 122063-39-2, 167940-11-6, 52239-04-0, 105076-77-5, 84425-43-4, and 87606-56-2.

The following are preferred non-azo dyes: Disperse Blue 250, 354, 364, Solvent Violet 8, solvent blue 43, solvent blue 57, Lumogen F Blau 650, and Lumogen F Violet 570.

It is preferred that the dye is fluorescent.

The composition may also comprise between 0.0001 to 0.1 wt % of one or more other dyes selected from cotton substantive shading dyes of group consisting of: hydrolysed reactive dye; acid dye; and direct dye.

Balance Carriers and Adjunct Ingredients

The laundry treatment composition in addition to the dye comprises the balance carriers and adjunct ingredients to 100 wt % of the composition.

These may be, for example, surfactants, builders, foam agents, anti-foam agents, solvents, fluorescers, bleaching agents, and enzymes. The use and amounts of these components are such that the composition performs depending upon economics, environmental factors and use of the composition.

The composition may comprise a surfactant and optionally other conventional detergent ingredients. The composition may also comprise an enzymatic detergent composition which comprises from 0.1 to 50 wt %, based on the total detergent composition, of one or more surfactants. This surfactant system may in turn comprise 0 to 95 wt % of one or more anionic surfactants and 5 to 100 wt % of one or more nonionic surfactants. The surfactant system may additionally contain amphoteric or zwitterionic detergent compounds, but this in not normally desired owing to their relatively high cost.

The enzymatic detergent composition according to the invention will generally be used as a dilution in water of about 0.05 to 2 wt %.

It is preferred that the composition comprises between 2 to 60 wt % of a surfactant, most preferably 10 to 30 wt %. In general, the nonionic and anionic surfactants of the surfactant system may be chosen from the surfactants described "Surface Active Agents" Vol. 1, by Schwartz & Perry, Interscience 1949, Vol. 2 by Schwartz, Perry & Berch, Interscience 1958, in the current edition of "McCutcheon's Emulsifiers and Detergents" published by Manufacturing Confectioners Company or in "Tenside-Taschenbuch", H. Stache, 2nd Edn., Carl Hauser Verlag, 1981.

Suitable nonionic detergent compounds which may be used include, in particular, the reaction products of compounds having a hydrophobic group and a reactive hydrogen atom, for example, aliphatic alcohols, acids, amides or alkyl phenols with alkylene Oxides, especially ethylene oxide either alone or with propylene oxide. Specific nonionic detergent compounds are $C_6$ to $C_{22}$ alkyl phenol-ethylene oxide condensates, generally 5 to 25 ED, i.e. 5 to 25 units of ethylene oxide per molecule, and the condensation products of aliphatic $C_8$ to $C_{18}$ primary or secondary linear or branched alcohols with ethylene oxide, generally 5 to 40 EO.

Suitable anionic detergent compounds which may be used are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher $C_8$ to $C_{18}$ alcohols, produced for example from tallow or coconut oil, sodium and potassium alkyl $C_9$ to $C_{20}$ benzene sulphonates, particularly sodium linear secondary alkyl $C_{10}$ to $C_{15}$ benzene sulphonates; and sodium alkyl glyceryl ether sulphates, especially those ethers of the higher alcohols derived from tallow or coconut oil and synthetic alcohols derived from petroleum. The preferred anionic detergent compounds are sodium $C_{11}$ to $C_{15}$ alkyl benzene sulphonates and sodium $C_{12}$ to $C_{18}$ alkyl sulphates. Also applicable are surfactants such as those described in EP-A-328 177 (Unilever), which show resistance to salting-out, the alkyl polyglycoside surfactants described in EP-A-070 074, and alkyl monoglycosides.

Preferred surfactant systems are mixtures of anionic with nonionic detergent active materials, in particular the groups and examples of anionic and nonionic surfactants pointed out in EP-A-346 995 (Unilever). Especially preferred is surfactant system that is a mixture of an alkali metal salt of a $C_{16}$ to $C_{18}$ primary alcohol sulphate together with a $C_{12}$ to $C_{15}$ primary alcohol 3 to 7 EO ethoxylate.

The nonionic detergent is preferably present in amounts greater than 10%, e.g. 25 to 90 wt % of the surfactant system. Anionic surfactants can be present for example in amounts in the range from about 5% to about 40 wt % of the surfactant system.

Cationic Compound

When the present invention is used as a fabric conditioner it needs to contain a cationic compound.

Most preferred are quaternary ammonium compounds.

It is advantageous if the quaternary ammonium compound is a quaternary ammonium compound having at least one $C_{12}$ to $C_{22}$ alkyl chain.

It is preferred if the quaternary ammonium compound has the following formula:

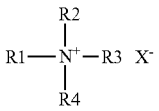

in which $R^1$ is a $C_{12}$ to $C_{22}$ alkyl or alkenyl chain; $R^2$, $R^3$ and $R^4$ are independently selected from $C_1$ to $C_4$ alkyl chains and $X^-$ is a compatible anion. A preferred compound of this type is the quaternary ammonium compound cetyl trimethyl quaternary ammonium bromide.

A second class of materials for use with the present invention are the quaternary ammonium of the above structure in which $R^1$ and $R^2$ are independently selected from $C_{12}$ to $C_{22}$ alkyl or alkenyl chain; $R^3$ and $R^4$ are independently selected from $C_1$ to $C_4$ alkyl chains and $X^-$ is a compatible anion.

A detergent composition according to claim 1 in which the ratio of (ii) cationic material to (iv) anionic surfactant is at least 2:1.

Other suitable quaternary ammonium compounds are disclosed in EP 0 239 910 (Procter and Gamble)

It is preferred if the ratio of cationic to nonionic surfactant is from 1:100 to 50:50, more preferably 1:50 to 20:50.

The cationic compound may be present from 0.02 wt % to 20 wt % of the total weight of the composition.

Preferably the cationic compound may be present from 0.05 wt % to 15 wt %, a more preferred composition range is from 0.2 wt % to 5 wt %, and most preferably the composition range is from 0.4 wt % to 2.5 wt % of the total weight of the composition.

If the product is a liquid it is preferred if the level of cationic surfactant is from 0.05 wt % to 10 wt % of the total weight of the composition. Preferably the cationic compound may be present from 0.2 wt % to 5 wt %, and most preferably from 0.4 wt % to 2.5 wt % of the total weight of the composition.

If the product is a solid it is preferred if the level of cationic surfactant is 0.05 wt % to 15 wt % of the total weight of the composition. A more preferred composition range is from 0.2 wt % to 10 wt %, and the most preferred composition range is from 0.9 wt % to 3.0 wt % of the total weight of the composition.

Bleaching Species

The laundry treatment composition may comprise bleaching species. The bleaching species, for example, may selected from perborate and percarbonate. These peroxyl species may be further enhanced by the use of an activator, for example, TAED or SNOBS. Alternatively or in addition to, a transition metal catalyst may used with the peroxyl species. A transition metal catalyst may also be used in the absence of peroxyl species where the bleaching is termed to be via atmospheric oxygen, see, for example WO02/48301. Photobleaches, including singlet oxygen photobleaches, may be used with the laundry treatment composition. A preferred photobleach is vitamin K3.

Fluorescent Agent

The laundry treatment composition most preferably comprises a fluorescent agent (optical brightener). Fluorescent agents are well known and many such fluorescent agents are available commercially. Usually, these fluorescent agents are supplied and used in the form of their alkali metal salts, for example, the sodium salts. The total amount of the fluorescent agent or agents used in laundry treatment composition is generally from 0.005 to 2 wt %, more preferably 0.01 to 0.1 wt %. Preferred classes of fluorescer are Di-styryl biphenyl compounds, e.g. Tinopal (Trade Mark) CBS-X, Di-amine stilbene di-sulphonic acid compounds, e.g. Tinopal DMS pure Xtra and Blankophor (Trade Mark) HRH, and Pyrazoline compounds, e.g. Elankophor SN. Preferred fluorescers, are: sodium 2 (4-styryl-3-sulfophenyl)-2H-napthol[1,2-d] trazole, disodium 4,4'-bis{[(4-anilino-6-(N methyl-N-2 hydroxyethyl) amino 1,3,5-triazin-2-yl)]amino}stilbene-2-2'disulfonate, disodium 4,4'-bis{[(4-anilino-6-morpholino-1,3,5-triazin-2-yl)]amino}stilbene-2-2'disulfonate, and disodium 4,4'-bis(2-sulfoslyryl)biphenyl.

EXAMPLES

Example 1

Approximately 1000 ppm solutions of the dyes listed in the table below, were made in ethanol.

A stock solution of 1.8 g/L of a base washing powder in water was created. The washing powder contained 18% NaLAS, 73% salts (silicate, sodium tri-poly-phosphate, sulphate, carbonate), 3% minors including perborate, fluorescer and enzymes, remainder impurities and water. The solution was divided into 100 ml aliquots and the solvent dyes added from the ethanol solutions to give 5.8 ppm solutions. 1 g of pure woven polyester fabric was added to each of the wash solutions and the solution then shaken for 30 minutes, rinsed and dried. From the colour of the fabric it was clear that dye had deposited to the fabric. To quantify this the colour was measured using a reflectance spectrometer and expresses as the deltaE value compared to a polyester washed analogously but without dye present.

The results are given below

| Dye | Dye—ppm in solution | deltaE |
|---|---|---|
| No dye (to indicate error level) | 0 | 0.2 |
| 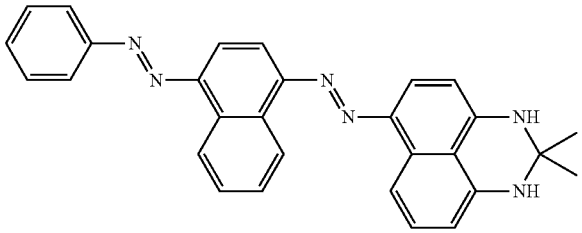 solvent black 3 | 5.7 | 5.0 |

-continued

| Dye | Dye—ppm in solution | deltaE |
|---|---|---|
| 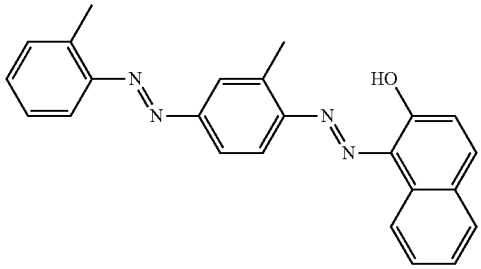 solvent red 24 | 5.8 | 10.6 |
| 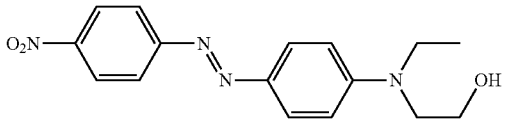 disperse red 1 | 5.8 | 10.9 |
| 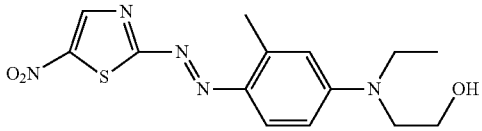 disperse blue 106 | 5.8 | 4.8 |

Example 2

50 ppm solutions of the dyes listed in the table below, were made in ethanol. Concentration refers to dyes as received from the supplier. In general solvent dyes are pure (>90%) and disperse dyes have purities in the range 20-50%.

A stock solution of 1.8 g/L of a base washing powder in water was created. The washing powder contained 18% NaLAS, 73% salts (silicate, sodium tri-poly-phosphate, sulphate, carbonate), 3% minors including perborate, fluorescer and enzymes, remainder impurities and water. The solution was divided into 100 ml aliquots and the dyes added from the ethanol solutions with rapid stirring to give 200 ppb solutions. 1 g of pure knitted polyester fabric was added to each of the wash solutions and the solution then shaken for 30 minutes, rinsed and dried. From the colour of, the fabric it was clear that dye had deposited to the fabric. To quantity this the colour was measured using a reflectance spectrometer and expresses as the delta E value compared to a polyester washed analogously but without dye present. Following the washes the Ganz whiteness of the cloth was also measured (see "assessment of Whiteness and Tint of Fluorescent Substrates with Good Instrument Correlation" *Colour Research and Application* 19, 1994).

The experiments were repeated using knitted nylon as a fabric type.

The results are displayed in the table below.

| Dye<br>Maximum visible absorption wavelength in ethanol given. | OD 10 cm | Ganz | ΔE polyester | ΔE nylon | CT |
|---|---|---|---|---|---|
| Control | 0 | 81 | 0.1 | 0.4 | — |
| 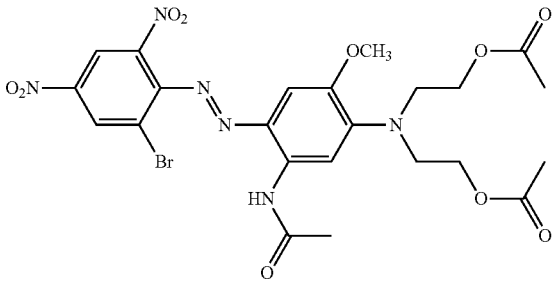 Disperse Blue 79:1 (576 mn)<br>LogP = 4.5 | 0.048 | 113 | 4.7 | 1.7 | 96 |

-continued

| Dye<br>Maximum visible absorption wavelength in ethanol given. | OD<br>10 cm | Ganz | ΔE<br>polyester | ΔE<br>nylon | CT |
|---|---|---|---|---|---|
| 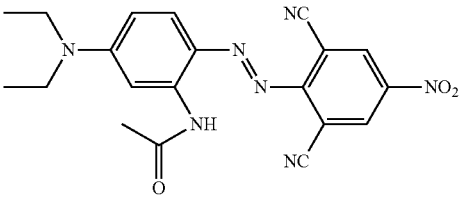 <br>Disperse Blue 165 (611 nm)<br>LogP = 3.5 | 0.014 | 129 | 7.5 | 5.0 | 107 |
| Disperse Blue 367 (610 nm) | 0.0067 | 91 | 1.4 | 1.1 | 250 |
| Solvent blue 43 | 0.33 | 88 | 0.9 | 0.4 | 2.1 |
| Triphenylmethane (602 nm) | | | | | |
| Lumogen F Blau 650 (ex BASF) | — | 88 | 0.3 | 0.6 | — |
| Lumogen F Violett 570 (ex BASF) | — | 87 | 0.1 | 0.2 | — |
| 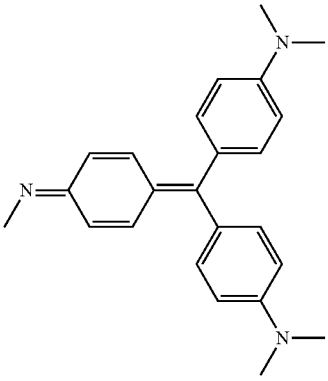 <br>Solvent Violet 8 (Methyl Violet B Base) (580 nm)<br>LogP = 4.5 | 0.26 | 89 | 1.1 | 0.6 | 3.5 |
| 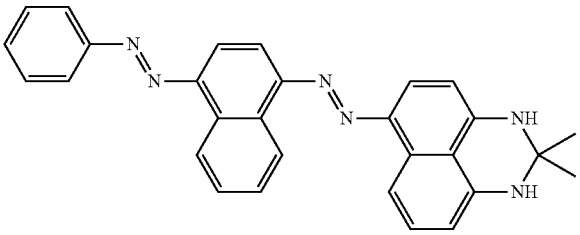 <br>solvent black 3 (604 nm)<br>logP = 8.5 | 0.11 | 74 | 1.5 | 0.6 | 6.4 |
| Dianix Violet CC (550 nm) (ex Dystar) | 0.013 | 132 | 8.0 | 7.5 | 623 |
| 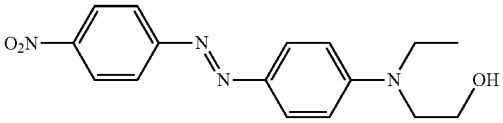 <br>Disperse red 1 (482 nm)<br>LogP = 4.0 | 0.023 | 71 | 3.4 | 11.8 | 150 |

Table-notes

The ganz whiteness values are accurate to +/−5 units.

All deltaE measurements are UV excluded.

Only where known is the structure of the dye given.

The optical density, OD, is that of a 200 ppb solution in water at 10 cm. The value was obtained by extrapolated from from measurement in ethanol solutions at higher levels for accuracy.

CT is a measure of the Colour Transferred from the wash solution to the polyester and is defined as:

$$CT = \text{delta}E/OD$$

From the deltaE results in the table all the dyes coloured the polyester.

From the Ganz results, dyes which are blue or violet increase the whiteness. The Black and red dyes decrease the whiteness.

The lumogen dyes add fluorescence to the polyester, as observed by eye in a light box with UV-irradiation.

Example 3

The experiment of example 2 was repeated, but using 40 ppb of the dyes listed below. The L:C was changed to 30:1 and consisted by weight of 43% woven polyester and 57% non-mercerised cotton sheeting. The Ganz whiteness of the polyester was 89 for disperse blue 79:1. Whiteness benefits were also observed on the cotton. Repetition of the experiment using nylon, also gave benefits.

We claim:

1. A laundry method of simultaneously washing and whitening a polyester-containing textile garment, the method comprising:

(a) treating under normal domestic wash conditions a polyester-containing textile garment with an aqueous solution comprising:

(i) from 1 ppb to 5 ppm of a hydrophobic non-azo dye selected from the group consisting of a methine dye, a pyrazole dye, a naphthoquinone dye, a phthalocyanine dye and a triphenylmethane dye, wherein the hydrophobic non-azo dye, when deposited onto the polyester-containing textile garment, provides a blue or violet shade to the garment that imparts a shading whiteness benefit thereto, and (ii) from 0.2 g/L to 3 g/L of a detersive surfactant, which is a mixture of at least one anionic surfactant and at least one nonionic surfactant, wherein the nonionic surfactant is present in an amount greater than 10 wt % of the total surfactant; and (b) rinsing and drying the polyester-containing textile garment, wherein (a) provides a simultaneous washing and shading whiteness benefit to the polyester-containing textile garment.

2. The laundry method of claim 1, wherein the hydrophobic non-azo dye is selected from the group consisting of Disperse Blue 250, Disperse Blue 354, Disperse Blue 364, Solvent Violet 8, solvent blue 43, and solvent blue 57.

3. The laundry method according to claim 1, wherein the aqueous solution further comprises a fluorescer other than the hydrophobic non-azo dye.

4. The laundry method according to claim 1, wherein the hydrophobic non-azo dye is present in the range of from 10 ppb to 200 ppb.

5. The laundry method according to claim 1, wherein the aqueous solution has an ionic strength of from 0.001 to 0.5.

6. The laundry method according to claim 1, wherein the aqueous solution further comprises from 1 ppb to 5 ppm one or more cotton substantive shading dyes selected from the group consisting of hydrolysed reactive dye, acid dye and direct dye.

7. The laundry method according to claim 1, wherein the aqueous solution further comprises at least one enzyme.

8. A laundry treatment composition suitable for use in a method of simultaneously washing and whitening a polyester-containing textile garment under normal domestic wash conditions, comprising:

(a) between 0.0001 to 0.1 wt % of a hydrophobic non-azo dye selected from the group consisting of a methine dye, a pyrazole dye, a naphthoquinone dye, a phthalocyanine dye and a triphenylmethane dye, wherein the hydrophobic non-azo dye, when deposited onto a polyester-containing textile garment, provides a blue or violet shade to the garment that imparts a shading whiteness benefit thereto;

(b) between 2 and 60 wt % of a detersive surfactant, wherein the detersive surfactant is a mixture of at least one anionic surfactant and at least one nonionic surfactant; and (c) at least one enzyme.

9. The laundry treatment composition of claim 8, wherein the hydrophobic non-azo dye is selected from the group consisting of Disperse Blue 250, Disperse Blue 354, Disperse Blue 364, Solvent Violet 8, solvent blue 43, and solvent blue 57.

10. The laundry treatment composition according to claim 8, wherein the detersive surfactant is between 10 and 30 wt %.

11. The laundry treatment composition according to claim 8, wherein the nonionic surfactant is present in an amount greater than 10 wt % of the total surfactant.

12. The laundry treatment composition according to claim 8, further comprises a fluorescer other than the hydrophobic non-azo dye.

13. The laundry treatment composition according to claim 8, further comprising one or more cotton substantive shading dyes selected from the group consisting of hydrolysed reactive dye, acid dye and direct dye.

* * * * *